United States Patent [19]

Ehinger

[11] 4,061,278

[45] Dec. 6, 1977

[54] ARRANGEMENT FOR COMMINUTING AND/OR SHREDDING OF PAPER AND SYNTHETIC MATERIALS

[76] Inventor: Adolf Ehinger, Goethester, 10, 7460 Balingen, Germany

[21] Appl. No.: 675,998

[22] Filed: Apr. 12, 1976

[30] Foreign Application Priority Data

Apr. 12, 1975 Germany ..... 2516111

[51] Int. Cl.[2] ..... B02C 18/22

[52] U.S. Cl. ..... 241/74; 241/222; 241/236

[58] Field of Search ..... 241/74, 187, 222, 224, 241/225, 236

[56] References Cited

U.S. PATENT DOCUMENTS

| | | | |
|---|---|---|---|
| 2,138,715 | 11/1938 | Thorsen | 241/74 |
| 2,684,206 | 7/1954 | Zettel | 241/74 X |
| 3,658,263 | 4/1972 | Zeisler | 241/74 X |
| 3,834,632 | 9/1974 | Docksteader | 241/187 |

FOREIGN PATENT DOCUMENTS

| | | | |
|---|---|---|---|
| 754,537 | 3/1967 | Canada | 241/74 |
| 256,476 | 3/1970 | U.S.S.R. | 241/74 |

*Primary Examiner*—Roy Lake
*Assistant Examiner*—Howard H. Goldberg

[57] ABSTRACT

A comminuting and shredding arrangement having a cutting and/or tearing mechanism for comminuting paper cardboard and synthetic materials. A housing is rotatably mounted and has inwardly projecting paddles which feed the material to be comminuted towards a cutting and tearing mechanism operatively mounted in said housing, thereby recycling the material to be comminuted therethrough.

4 Claims, 11 Drawing Figures

ARRANGEMENT FOR COMMINUTING AND/OR SHREDDING OF PAPER AND SYNTHETIC MATERIALS

BACKGROUND OF THE INVENTION

The invention relates to a comminuting and/or shredding arrangement which effects a cutting and/or tearing of materials, in particular disposable items made of paper and synthetic materials, such as disposable cups, disposable plates and disposable syringes.

At present, the shredding and comminuting arrangements for paper and synthetic materials produce very small particles as the end product by cutting and/or tearing the materials which are fed into the arrangement. Such arrangements have very small cutting discs and very fine tearing teeth to carry out a fine comminuting and shredding operation. Consequently, such arrangements are very sensitive to overloads and can easily be damaged if there is metal present in the material that is fed into the arrangements. The arrangements of the state of the art also require a high energy input. The material to be shredded or comminuted traverses these arrangements relatively slowly. Consequently, the machines of the state of the art carry out the comminuting and shredding in an uneconomical manner. This uneconomical operation is also present in those comminuting and shredding arrangements where the cutting and/or tearing members are mounted one behind the other, each carrying out a separate but progressive cutting and/or tearing operation. Such arrangements have very low efficiency while the machine itself is rather complex and costly and takes up a lot of space.

SUMMARY OF THE INVENTION

The invention provides a comminuting and shredding arrangement which is of simple construction and requires a relatively low energy input while at the same time carrying out a relatively fine comminuting and shredding operation of papers and synthetic materials fed into the arrangement. The degree of shredding and comminuting is adjustable in the arrangement of the invention.

The object of the invention is attained by mounting the cutting and/or tearing means in a housing which can be rotated. This housing is adpated to receive repeated loads of the to be comminuted and/or shredded material.

The cutting and/or tearing means of the arrangement of the invention have the advantage that they are only designed for a rough comminuting operation which makes it possible to construct the tools in a simple manner so that they require only a relatively low power input. The shredding and/or comminuting arrangement of this invention has, nevertheless, the ability of carrying out a very fine comminuting of the materials fed thereto. This object is attained by virtue of the movable housing feeding the to be comminuted material several times to the cutting and/or tearing tools, whereby the aforementioned tools effect firstly a rough comminuting and also further fine comminuting. It is possible to provide the actuating means for the cutting and tearing tools and the rotatable housing with a timed switching circuit which determines the empirically established running time for these means, whereby the to be comminuted material passes the tools a predetermined number of times in accordance with the desired comminuting degree that is to be attained by the arrangement.

The comminuting of the material can be intensified by providing the cutting discs or rollers with transverse grooves. In this manner, the comminuted material which has already assumed the shape of strips, can be entrained by one cutting disc so that it projects from one or both sides thereof and is then, when contacted by the cutting edge of the oppositely turning cutting disc, sheared or cut. Despite the fact that the cutting knives are mounted so that there is a minor play at the flanks thereof, the strips which are situated in the grooves of the cutting knife cannot turn or slip between adjacent clutting knives and thereby avoid the shearing process.

The turning axes of the cutting or tearing members and the turning axis of the housing can be disposed parallel or angularly relative to each other. If they are disposed angularly relative to each other, the repeated feeding of to be comminuted material can be facilitated by providing relatively short cutting members which do not occupy the entire depth of the drum. The cutting and/or tearing members can be centrally or excentrically rotatably mounted within the housing. A particularly advantageous construction provides that the entire comminuting arrangement is mounted on floating axles, which extend into the interior chamber of the movable housing. This movable housing is preferably formed as a drum which has at its front side an opening that may be closed. The drum is advantageously provided with entraining rods extending along the inner periphery thereof which act on the to be comminuted material. These entraining rods may be angularly disposed or cross each other so that they impart on the to be comminuted material a conveying action in an axial direction. This conveying action is, in one rotary direction, in the direction of the cutting tool, and in the opposite rotary direction, in the direction of the feed and ejection opening of the drum. The drum may be sealable in a dustproof manner, whereby the rotary housing together with the cutting and/or tearing members is swingable about a horizontal axis which facilitates the discharging of the drum.

The drum is preferably rotatably mounted about at least one approximately horizontal axis. This rotating drum may also be formed as a sieve and can have a portion made of transparent material which can, for example, be mutli-walled and can, for example, consist of two concentrically mounted sieving shells, which are slidable relative to each other in the peripheral direction. The two sieving drums or shells may have sieve openings that are differently dimensioned. In such a case, the comminuted material automatically falls out of the sieve drums or shells into a chamber situated underneath the sieve drums. This chamber may also take the form of a suction chamber. The falling out occurs as soon as the comminuted material which is continuously recycled, has reached a predetermined degree of fineness.

The drum may be formed as a closed or imperforate drum or as a sieve drum. The drum may be mounted on guide-rollers which bear against its outer periphery and can be additionally guided. At least one of the guide-rollers is driven. Advantageously the drum can be driven by a drive belt engaging and coacting with one or more of the guide-rollers, for example, a wedge shaped belt under tension, which coacts with the guiding and drive-rollers in a noise-dampening manner.

BRIEF DESCRIPTION OF THE DRAWING

The invention is set forth in more detail in the following detailed description of several embodiments taken in conjunction with the appended drawings, in which.

DETAILED DESCRIPTION

Figure 1:
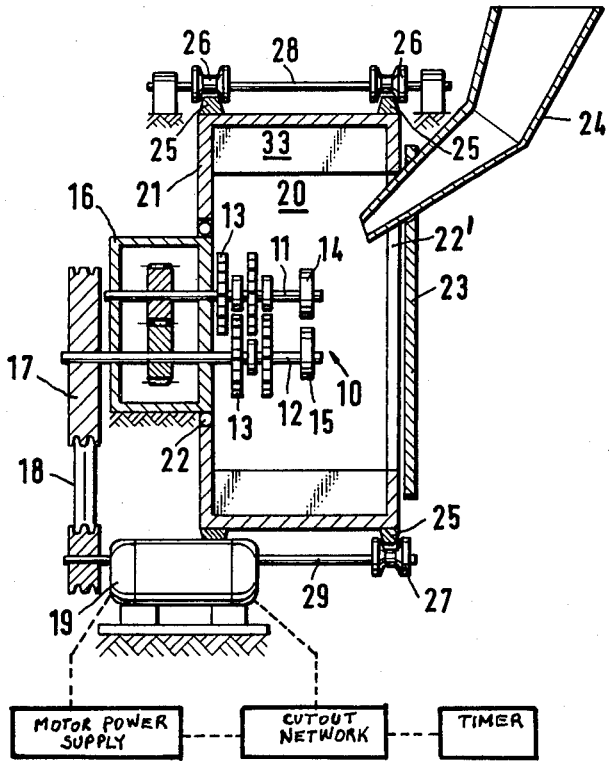
FIG. 1 is a schematic longitudinal sectional view of a comminuting arrangement of this invention having a drum which is rotatable about a horizontal axis.

Referring now to the drawings:

FIG. 1 illustrates schematically the more important members of the comminuting arrangement without illustrating the supporting means and the housing in which the comminuting arrangement is mounted. The cutting and/or tearing mechanism 10 of the arrangement is mounted on floating horizontal shafts 11 and 12 on which there are axially mounted toothed or serrated discs 13 by means of tightening nuts 14 and 15. The discs which are mounted on the respective shafts 11 and 12 are juxta-posed relative to each other and interdigitate in a known manner in the cutting region between the shafts 11 and 12. The shafts 11 and 12 are mounted in a stationary housing 16 and are driven by a stationarily mounted electromotor 19 via a drive belt 18 and a drive pulley 17. The drive pulley 17 acts as a fly-wheel. As can be noted from FIGS. 2*a* and 2*b* cutting discs 13 of the cutting arrangement are provided with rough teeth and have transverse grooves 34, which grip the transversely positioned strips 35 or rods or pipes 36 of cut material and bring this material into a region in which the comminuting thereof in a manner described herein above is accomplished.

The cutting and/or tearing mechanism 10 extends into the interior chamber 20 of a cylindrical drum 21 which is rotatable on a ball bearing 22 illustrated schematically in FIG. 1. The ball bearing 22 is mounted on the housing 16 so that the drum 21 is rotatable about the horizontal axis around the housing 16. The drum 21 is provided with entraining paddles or straps 33 mounted on the interior peripheral surface thereof. The drum is provided, on the side opposite the housing 16, with an opening 22' which is sealed by means of a stationary cover 23 in a dust-proof manner. A feed funnel 24 extends through the cover 23 into the region of the cutting mechanism 10. This feed funnel 24 can serve simultaneously for measuring the charge of material to be cut which is fed via this feed funnel into the rotating drum 21.

Two V-shaped rings 25 are mounted on the outside of the drum surface and coact, for example, with three pairs of guide and support rollers 26 and 27 which are uniformly spaced around the periphery of the drum. The guide rollers 26 are rotatably mounted on a stationary shaft 28 and provide for a stable support of the drum 21 which is driven by the lower guide and support roller 27. The guide and support roller 27 acts as a friction drive wheel and is driven by the electromotor 19 via a shaft 29.

Figure 1A:
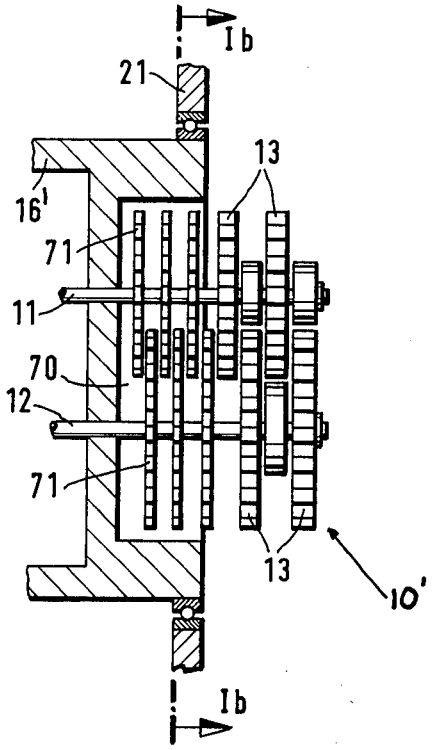
FIG. 1*a* is a longitudinal schematic section of an alternate form of cutting means of a comminuting arrangement corresponding in operation to the cutting means of FIG. 1.
Figure 1B:
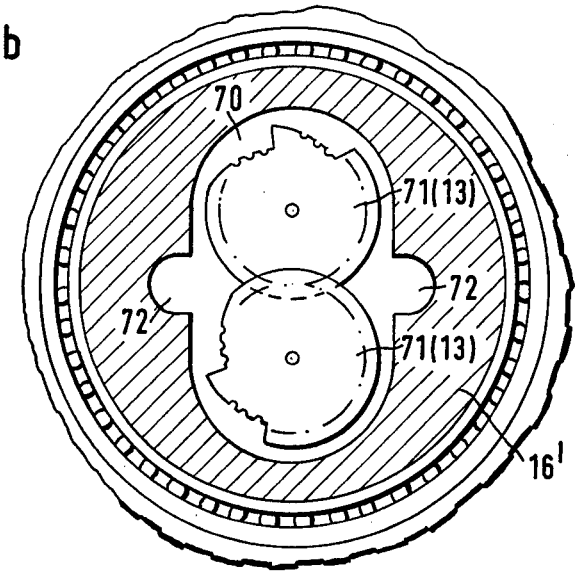
FIG. 1*b* is a schematic sectional view along line Ib—Ib in FIG. 1*a;*

FIG. 1*a* illustrates, in partial longitudinal section, an alternate embodiment of the cutting and tearing mechanism 10' of a comminuting arrangement. In this embodiment the housing 16' for the driving gears is provided on the side facing the drum 21 with a recess 70. In this recess there is disposed, coaxially with the serrated or toothed discs 13 mounted on the shafts 11 and 12, a further cutting mechanism. This additional cutting mechanism consists of a number of thinner toothed or serrated discs 71 which carry out, in accordance with their thickness a further comminuting on already comminuted parts of material. In order to avoid the entrance of large particles in the region of the finer cutting discs 71, the region in which the thin cutting discs 71 are mounted, is accessable only over relatively narrow lateral bulges 72 of the recess 70. These bulges 72 provide access of material which has been comminuted by the relatively rough toothed or serrated discs 13 into the region for further comminuting of the fine toothed or serrated discs 71.

Figure 2:
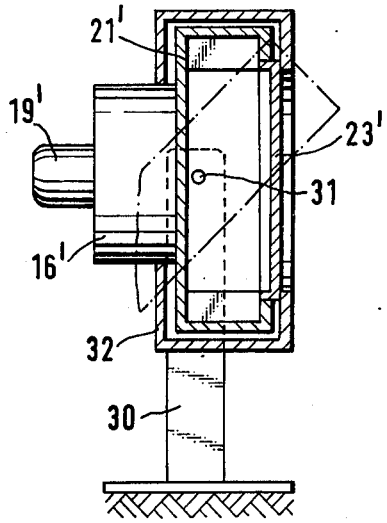
FIG. 2 is a comminuting arrangement which is mounted in a swingable housing.
Figure 2A:
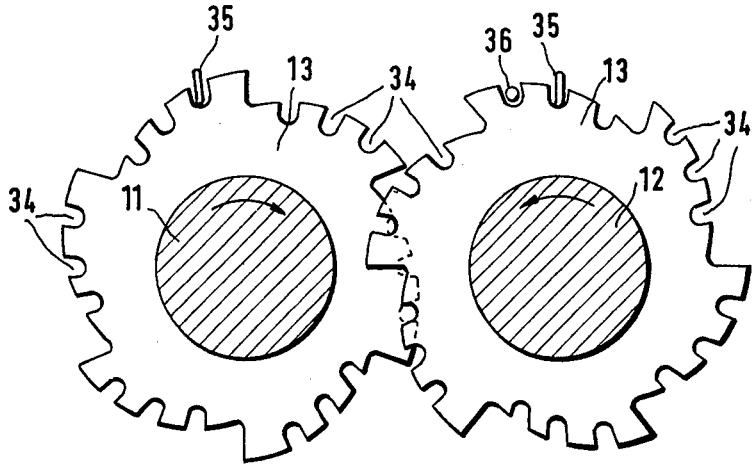
FIG. 2*a* is a schematic cross-sectional view through the cutting and tearing members of the arrangement.
Figure 2B:
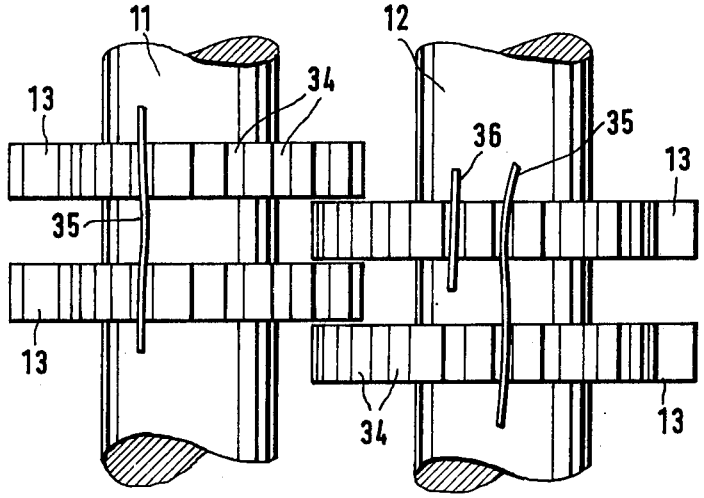
FIG. 2*b* is a partial plan view of the cutting and tearing members illustrated in FIG. 2*a;*
Figure 4:
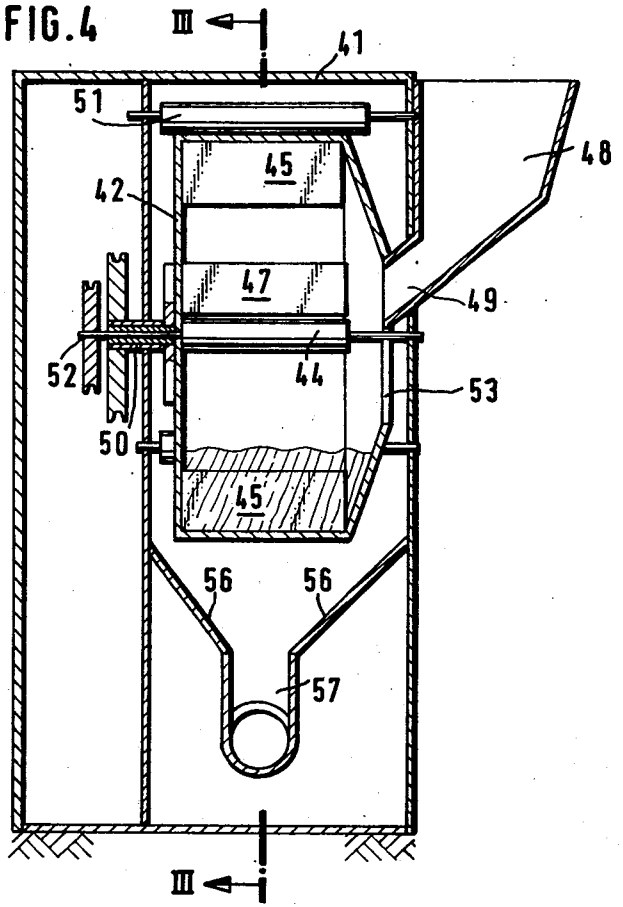
FIG. 4 is a longitudinal sectional view through the comminuting arrangement having a sieve drum along line IV—IV of FIG. 3.
Figure 3:
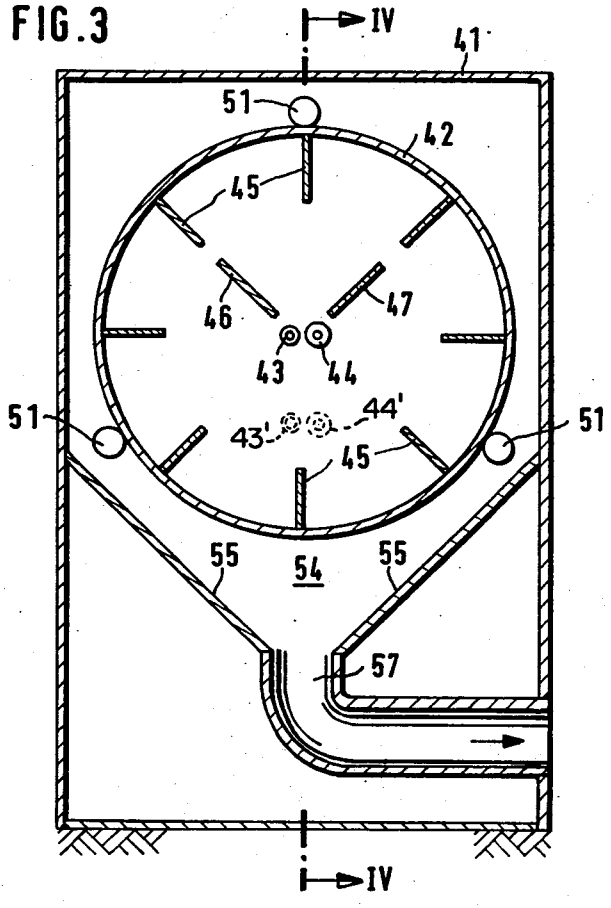
FIG. 3 is a cross-sectional view along line III—III of FIG. 4 of a comminuting arrangement having a sieve drum.

FIG. 2 illustrates a comminuting arrangement, which is swingable about a horizontal axis 31 supported on a frame 30. The rotatable drum 21' is surrounded by a housing 32 and is sealed by means of a cover 23'. The arrangement is driven via a flange-mounted motor 19' which is mounted on the housing 16' and swings jointly with the housing 32. The swingability of the drum 21' favors the comminuting of the arrangement as well as the emptying of the drum 21'.

The to be comminuted material, for example the contents of one or more waste baskets, is fed via the funnel 24 or the opening 22 into the inner space 20 of the drum 21 or 21'. Thereafter, the switching on of the electromotor 19, 19' causes an actuation of the cutting and/or tearing mechanism 10, 10' as well as a rotation of the drum 21, 21'. When the drum 21, 21' is so rotated, the material to be comminuted is lifted with the aid of the paddles 33 over the cutting and tearing mechanism 10, 10' so that it returns constantly again into the operative region of the comminuting mechanism. A programmed switching circuit (not illustrated) is instrumental in causing an actuation of the drum and the cutting mechanism for a predetermined period of time, that is until the to be comminuted material has been sufficiently recycled between the toothed or serrated discs 13 and has reached a desired fineness. Thereafter the drum is emptied. According to the embodiment of FIG. 2, this can be carried out by swinging the drum 21' about the axis 31. Furthermore, the emptying of the open drum can be effected by positioning the paddles 33 obliquely or crosswise and rotating the drum in an opposite direction via the drive motor 19.

FIGS. 3 to 7 illustrate a comminuting and shredding arrangement in which the drum walls are formed as sieves. A sieve drum 42 is rotatably and concentrically mounted relative to a cutting mechanism which is mounted on both cutting disc shafts 43 and 44. However, it is also possible to mount the cutting mechanism excentrically relative to the drum, in the lower half of the drum. As represented schematically in dotted lines in FIG. 3, such eccentric mounting is depicted in connection with a pair of cutting disc shafts designated 43' and 44', corresponding to the centrally located discs 43 and 44 shown in solid lines.

The sieve drum 41 is provided on its cylindrical outer wall with non-illustrated sieve openings and has to the inner side of this wall affixed a plurality of uniformly spaced transverse paddles 45 with which the material which drops into the lower portion of the drum is transported upwardly into the feeding region which is formed by two inclined walls 46 and 47. The walls 46 and 47 form jointly a receiving funnel. The material to be comminuted is fed via feed funnel 48 and an inlet opening 53 in the side wall of the sieve drum 42 towards the cutting mechanism of this sieve drum 42.

The sieve drum is floatingly mounted on a hollow drive shaft 50 and is furthermore supported by means of three uniformly spaced rollers 51, which bear against the outer peripheral surface of the sieve drum 42. The sieve drum 42 can also be driven via the support rollers 51. The drive of both cutting rollers 43 and 44 of the cutting mechanism is effected by means of a drive shaft 52 which is concentrically arranged relative to the hollow shaft 50. The drive of all rotating parts is effected by means of one or two electromotors which have not been illustrated in detail. These electromotors can rotate the rotating parts via V-shaped rings and belts or via a gear train. As can be noted from FIG. 4, the drive pulleys for the shafts 50 and 52 are provided with V-shaped grooves for receiving the aforementioned, non-illustrated, V-shaped belts. The housing 41 extends below the sieve drum 42 and includes a waste receiving chamber 54. This chamber 54 has inclined bottom walls 55 and 56 which terminate into an exhaust channel 57.

The to be comminuted material, for example files, are thrown into the feed funnel 48 and fall through the funnel end 49 into the sieve drum 42. A portion of the papers reaches directly the area between the inclined walls 46 and 47 of the receiving funnel and is thereby directly fed between the cutting rollers 43, 44 and is thereby comminuted immediately into shreds, strips etc. The portion of the papers which fall into the sieving drum 42 but which cannot pass through the sieving drum because the particles being larger than the openings in the sieving drum, is transported by means of the training paddles 45 in the region above the inclined walls 46, 47 and falls into the region of the cutting drums 43, 44 where it is comminuted. This cyclical circulatory movement of the to be comminuted material in the drum continues as long as the shreds, strips etc. are so finely comminuted by the cutting rollers 43, 44 that they can fall through the openings in the sieve drum downwardly into the waste chamber 54 and are sucked out by means of a suction device through the channel 57 into a storage chamber or into a combustion chamber.

Figure 5:
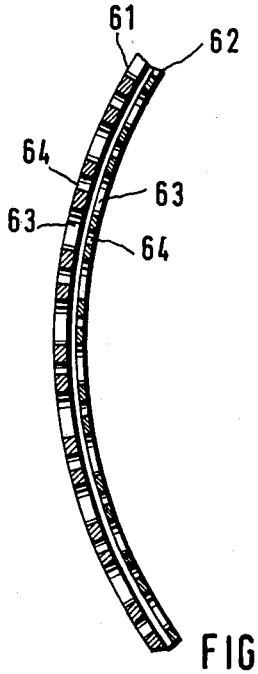
FIG. 5 is a schematic partial cross-section through a double-walled sieve drum, wherein the two drum shells are shown in a relative first position.
Figure 6:
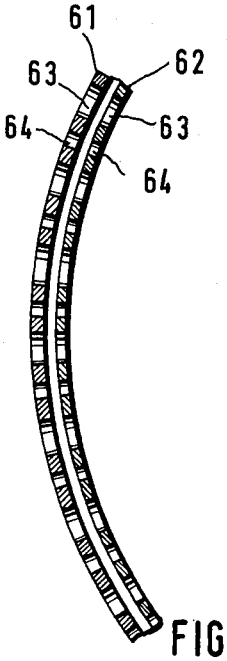
FIG. 6 is a schematic partial cross-section of a double-walled sieve drum, wherein the drum shells are shown in relative second position.
Figure 7:
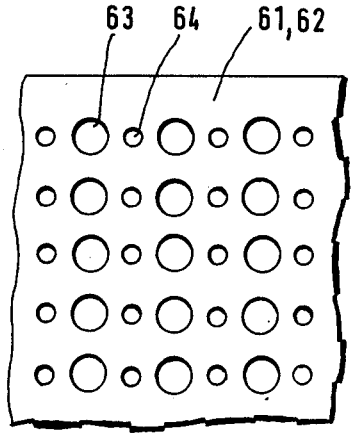
FIG. 7 is a plan view of a portion of the wall of this sieve drum.

According to the invention, the drum can consist of two or more concentrically arranged drum shells. There is illustrated in FIGS. 5 and 6 a cross-sectional view through a portion of a double wall sieving drum. This double walled drum has an outer drum shell 61 and an inner drum shell 62. Both drum shells 61 and 62 may be slidably displaced in a peripheral direction by means of an adjusting arrangement (not illustrated) along a small angular distance relative to each other and then are secured in position relative to each other. Both drum shells area, according to the illustration of FIG. 7, provided with rows of sieve holes along straight lines. The rows of sieve holes are equidistantly arranged on the drum shells and a row of large sieve holes 63 alternates with a row of smaller sieve holes 64. Both sieve drums 61 and 62 are constructed identically, that is, they have identically dimensioned rows of sieve holes which are identically spaced.

When adjusting the relative position of both drum shells 61 and 62 according to FIG. 5, there is at all times disposed a small sieve hole 64 of one drum shell over a large sieve hole 63 of the other drum shell. This adjustment insures that only shreds, particles, strips etc. can pass through the drum shells which have a diameter that is smaller than the diameter of the smaller sieve holes 64.

With the adjustment as illustrated in FIG. 6 both drum shells 61 and 62 are positioned relative to each other so that a large sieve hole 63 of one drum shell is positioned opposite a large sieve hole 63 of the other drum shell and a small sieve hole 64 of one drum shell is positioned opposite a small sieve hole 64. In this position there can pass through the drum shells of the drum larger particles, shreds, strips and fall out of the drum. The diameter of such particles, shreds, strips etc. must of course be smaller than the diameter of the larger sieve holes 63.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a comminuting arrangement, a housing supported for rotation about a first axis and for pivotal movement about a second axis perpendicular to the first axis, first and second shafts disposed in the housing parallel to said first axis, at least the first shaft being supported for rotation about its axis, means comprising spaced discs affixed to the first and second shafts within the housing and intermeshing to form a nip therebetween for shredding material introduced into the nip from above when at least the first shaft is rotated, means for introducing material to be shredded into the housing, means disposed on the interior of the periphery of the housing for effecting movement so that the material in the housing moves jointly with the housing when the housing is rotated until said material is disposed above the nip of the shredding means, means for rotating the housing about the first axis, and means for rotating the first shaft about its own axis.

2. An arrangement as defined in claim 1, in which the housing comprises a cylindrical drum having a first apertured wall, and in which the arrangement further comprises a second cylindrical apertured wall disposed externally of and concentric with the first apertured wall, each of the first and second walls having a plurality of apertures of different sizes, the second wall being rotatable about the first axis to align at least some of the respective apertures in the first and second walls.

3. In a comminuting arrangement, a housing supported for rotation about a first axis and having a centrally apertured plate disposed therein, the plate extending perpendicular to the first axis intermediate the axial ends of the housing, first and second shafts disposed in the housing parallel to said first axis and extending through the aperture in the plate, at least the first shaft being supported for rotattion about its axis, first means comprising spaced rough-cutting discs affixed to the first and second shafts within the housing on one side of the plate and intermeshing to form a nip therebetween for shredding material introduced into the nip from above when at least the first shaft is rotated, second means comprising spaced, fine-cutting discs affixed to the first and second shafts in axially spaced relation to the rough-cutting discs within the housing on the other side of the plate and intermeshing to form a nip therebetween for shredding material introduced into the nip through the aperture in the plate when at least the first shaft is rotated, means for introducing material to be shredded into the housing, means disposed on the interior of the periphery of the housing for effecting movement so that the material in the housing moves jointly with the housing when the housing is rotated until said material is disposed above the nip of at least the first shredding means, means for rotating the housing about the first axis, and means for rotating the first shaft about its axis.

4. An arrangement as defined in claim 3, in which the housing comprises a cylindrical drum having a first apertured wall, and in which the arrangement further comprises a second cylindrical apertured wall disposed externally of and concentric with the first apertured wall, each of the first and second walls having a plurality of apertures of different sizes, the second wall being rotatable about the first axis to align at least some of the respective apertures in the first and second walls.

* * * * *